US007575050B2

(12) United States Patent
Dale et al.

(10) Patent No.: US 7,575,050 B2
(45) Date of Patent: Aug. 18, 2009

(54) METHOD AND APPARATUS FOR A DOWNHOLE EXCAVATION IN A WELLBORE

(75) Inventors: Bruce A. Dale, Sugar Land, TX (US); John W. Mohr, Surrey Hills (AU)

(73) Assignee: ExxonMobil Upstream Research Company, Houston, TX (US)

( * ) Notice: Subject to any disclaimer, the term of this patent is extended or adjusted under 35 U.S.C. 154(b) by 350 days.

(21) Appl. No.: 10/547,439

(22) PCT Filed: Jan. 22, 2004

(86) PCT No.: PCT/US2004/001744

§ 371 (c)(1),
(2), (4) Date: Aug. 25, 2006

(87) PCT Pub. No.: WO2004/081333

PCT Pub. Date: Sep. 23, 2004

(65) Prior Publication Data

US 2007/0034409 A1 Feb. 15, 2007

Related U.S. Application Data

(60) Provisional application No. 60/453,440, filed on Mar. 10, 2003.

(51) Int. Cl.
*E21B 7/08* (2006.01)

(52) U.S. Cl. ..... 166/117.6; 166/387; 166/50; 175/81; 175/263

(58) Field of Classification Search ..... 166/387, 166/117.6, 313, 380, 50; 175/81, 57, 80, 175/263, 61
See application file for complete search history.

(56) References Cited

U.S. PATENT DOCUMENTS

| | | | | |
|---|---|---|---|---|
| 4,397,360 A | | 8/1983 | Schmidt | 175/61 |
| 4,573,540 A | | 3/1986 | Dellinger et al. | 175/61 |
| 4,697,651 A | | 10/1987 | Dellinger | 175/61 |
| 4,699,224 A | * | 10/1987 | Burton | 175/61 |
| 4,719,977 A | | 1/1988 | Dellinger | 175/61 |
| 4,807,704 A | | 2/1989 | Hsu et al. | 166/313 |
| 5,301,760 A | | 4/1994 | Graham | 175/61 |

(Continued)

OTHER PUBLICATIONS

PCT International Search Report dated Feb. 25, 2005, 4 pages.

*Primary Examiner*—Jennifer H Gay
*Assistant Examiner*—Daniel P Stephenson
(74) *Attorney, Agent, or Firm*—ExxonMobil Upstream Research Company-Law Department

(57) ABSTRACT

The method and apparatus can create excavation cavities suitable for drilling multilateral wellbores through the excavation using a kick-off. One embodiment of the method comprises isolating a wellbore at a determined location, excavating a downhole cavity in a wellbore above the determined location, and removing the apparatus for isolating the wellbore and the apparatus for excavating the downhole cavity from the wellbore to provide full access to the wellbore and the excavation cavity.

13 Claims, 7 Drawing Sheets

U.S. PATENT DOCUMENTS

| | | | | |
|---|---|---|---|---|
| 5,431,219 | A | 7/1995 | Leising et al. | 166/50 |
| 5,431,223 | A | 7/1995 | Konopczynski | 166/117.5 |
| 5,474,126 | A | 12/1995 | Lynde et al. | 166/117.6 |
| 5,488,989 | A | 2/1996 | Leising et al. | 166/255.3 |
| 5,697,445 | A | 12/1997 | Graham | 166/313 |
| 5,715,891 | A | 2/1998 | Graham | 166/313 |
| 5,857,531 | A | 1/1999 | Estep et al. | 175/75 |
| 5,960,873 | A | 10/1999 | Alexander et al. | 166/50 |
| 5,992,524 | A | 11/1999 | Graham | 166/313 |
| 6,047,774 | A | 4/2000 | Allen | 166/313 |
| 6,279,658 | B1 | 8/2001 | Donovan et al. | 166/313 |
| 6,457,525 | B1 | 10/2002 | Scott | 166/300 |

* cited by examiner

METHOD AND APPARATUS FOR A DOWNHOLE EXCAVATION IN A WELLBORE

This application is the National Stage of International Application No. PCT/US2004/01744, filed Jan. 22, 2004, which claims the benefit of U.S. Provisional Patent Application No. 60/453,440, filed Mar. 10, 2003.

FIELD OF THE INVENTION

This invention relates to downhole excavations in a wellbore. More particularly, this invention relates to a method and apparatus for downhole excavations in a wellbore suitable for creating a kick-off for a multi-lateral well.

BACKGROUND

In order to enhance the recovery of subterranean fluids, such as oil and gas, it is sometimes desirable to orient the direction of the wellbore or borehole. In an oil producing formation or strata which has limited vertical depth and relatively greater horizontal extent with respect to the surface of the earth, a wellbore which extends horizontally through the oil producing formation may be more productive than one extending vertically. In order to create an inclined, highly deviated or horizontal borehole, it is necessary to steer the drilling bit at the end of the drill string from a generally vertical orientation to a lateral or horizontal orientation.

In steering a drill bit and drill string from a vertical orientation to a horizontal or other non-vertical orientation, it is necessary to deflect or side-track the drill bit from the generally vertical borehole to a drilling direction inclined to the wall of the borehole. This initial step is also known as "kicking off" or a kick-off of the drill bit and drill string. It is typical to first drill a vertical wellbore and then attempt to deflect the drill bit and drill string by some means thereby causing it to drill through the wall of the existing wellbore.

When drilling a deviated wellbore from a cased well, a section of the casing must first be cut and removed. Once the casing is removed, an opening is provided for the drill bit to pass through the casing into the cement surrounding the casing and then through the formation.

The development of techniques for drilling relatively high angle deviated wells from a generally vertical wellbore has provided several advantages in recovering oil and gas from subterranean formations. One or more deviated or generally horizontal wellbores may be drilled from single generally vertical wellbore to provide wellbores which: (a) reach irregular reservoirs without additional wells being drilled from the surface, (b) limit the invasion of unwanted formation fluids, (c) penetrate natural vertical fractures (d) improve production from various types of formations or reservoirs and (e) provide new conduits for hydrocarbons to flow to the surface.

The creation of multi-lateral wells from either new or existing wellbores usually involves some sort of sidetracking process that utilizes whipstocks and/or section mills to create an exit point in the casing to allow a drilling assembly to "kick-off" from the main wellbore. During such procedures, communication is often severed with the main wellbore below the point of kick-off, thus eliminating the use of the lower portion of the main wellbore for the continued production of hydrocarbons. Also, these multi-lateral construction procedures result in wellbore diameters that are the same size or smaller than the existing wellbore.

For multi-lateral well drilling, section mills are generally not used since they result in complete severing of the main wellbore, which makes re-locating the main wellbore below the casing exit point difficult, if not impossible. Nonetheless, section mills offer the potential to improve multi-lateral well juncture construction due to the greater available space for creating a sealed hydraulic juncture while maintaining full-bore accessibility.

Downhole excavation would facilitate construction of multi-lateral wells in several ways. First, downhole excavation would allow creation of a large downhole cavity while maintaining access to the existing wellbore below the excavation point. Second, downhole excavation would provide an alternative method for "kicking off" the lateral from the main well bore in multi-lateral well drilling. Third, downhole excavation would provide a large area to facilitate construction of a hydraulically sealed juncture that maintains full-bore accessibility. Fourth, downhole excavation would provide a large excavated location where multiple laterals could be kicked-off from the same location in the parent casing bore.

A significant amount of technology has been developed in the area of multi-lateral wells and section milling to enlarge boreholes. However, no examples are available demonstrating the use of section mills to create large downhole cavities for multi-lateral well construction and permit access to parent casing bore below the kick-off.

Accordingly, there is a need for a method and apparatus to provide an excavation suitable for a multi-lateral well while maintaining full bore access below the excavation. This invention satisfies that need.

SUMMARY

An apparatus for excavating in a wellbore is disclosed. The apparatus comprises means for isolating a wellbore at a determined location, means for excavating a downhole cavity in a wellbore, and means for removing the means for isolating the wellbore and means to excavate the downhole cavity in the wellbore thereby providing full access to the wellbore and the excavation.

A second apparatus embodiment for excavating a wellbore is disclosed. This embodiment comprises a whipstock packer capable of isolating the wellbore below the whipstock packer and a drillpipe stringer above the whipstock packer comprising, a hollow washover ported-stub, means for the ports on the drillpipe stinger to direct drilling fluid flow to the annulus between the drillstring and casing, and a tapered top capable of receiving an overshot section milling assembly.

A method for excavating in a wellbore is disclosed. This embodiment comprises isolating a wellbore at a determined location, providing means for excavating a downhole cavity in a wellbore, excavating a downhole cavity in a wellbore above the determined location, and removing the means for isolating the wellbore and means for excavating the downhole cavity from the wellbore to provide full access to the wellbore and the excavation cavity.

A second method embodiment for excavating in a wellbore is disclosed. This embodiment comprises: (a) providing a whipstock packer in a wellbore at a desired orientation, (b) attaching a drillpipe stinger on top of the whipstock packer, the drillpipe stinger comprising a tapered top capable of attaching to an overshot section milling assembly on top of the drillpipe stinger and a hollow washover ported-stub, means for the drillpipe stinger ports to direct flow of drilling fluids to the annulus between the drillstring and casing wherein the circulation of drilling fluids removes drill cuttings, (c) attaching an overshot section milling assembly to the tapered top on the drillpipe stinger, (d) initiating the drillstring rotation to extend the section-mill retractable arm to cut a cavity in the casing, (e) initiating pumping operations to lift the cutting debris out of the well, (f) repeating steps (d) and (e) until the cavity has the desired size.

BRIEF DESCRIPTION OF THE DRAWINGS

FIG. 3(*b*) is a top view illustration of an external overshot whipstock assembly;

FIG. 4(*b*) is a top view illustration of an internal overshot whipstock assembly;

DETAILED DESCRIPTION

In the following detailed description and example, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

This invention provides a method and apparatus for excavating a wellbore. The excavations are suitable for creating multilateral wells through kick-offs. The apparatus requires means for isolating a wellbore at a determined location and means for excavating a downhole cavity in the wellbore. One method embodiment comprises isolating the wellbore, then excavating a cavity and finally removing the means for isolating and excavating the wellbore from the wellbore to provide full access to the wellbore and excavation cavity. This method embodiment can create large cavities having a diameter on the order of two to ten times the diameter of the original borehole.

Preferred devices to provide the means for isolating the wellbore at a determined location and for cutting a large downhole cavity include: whipstock packer, drillpipe stinger, overshot section-milling assembly, and an overshot whipstock assembly for lateral drilling. Persons skilled in the art may recognize other devices that are equivalent and can accomplish the same tasks. Therefore, the list of devices are not intended to be limiting but rather to provide specific examples of equipment than can be utilized to practice this invention.

Figure 1:
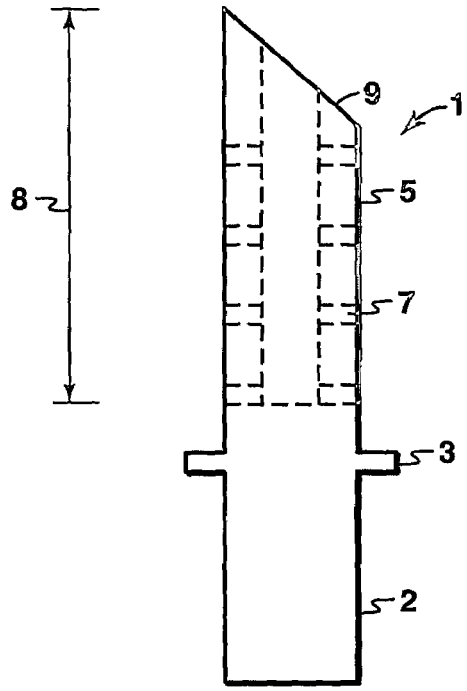
FIG. 1 is an illustration of a drillpipe stinger.

FIG. 1 shows a drillpipe stinger 1. This tool consists of a conventional seal area and a latch mechanism 3 that engages and anchors into a conventional whipstock packer (not shown) to temporarily isolate at a determined depth the wellbore below the whipstock packer. The drillpipe stinger includes a hollow ported-stub 5, with length 8 approximately 5 to 10 meters. The fluid ports 7 on the drillpipe stinger will divert flow of drilling fluid to the annulus between the drillstring and casing to allow for circulation of drilling fluid to remove drill cuttings. The top of the drillpipe stinger has a tapered face 9 to facilitate the receiving or mating of the overshot section milling assembly. In addition, the tapered face 9 can be adapted to receive and run an overshot whipstock assembly that would allow deflection of the drilling assembly into a section-milled cavity.

While this patent specifically discusses the drillpipe stinger assembly in order to maintain contact with the lower wellbore, persons skilled in the art will recognize other methods to maintain connectivity including cable or wireline guide ropes. A variety of materials could be utilized to temporarily bridge the gap between the existing upper and lower casing strings including specialized pipe or tubing.

Figure 2:
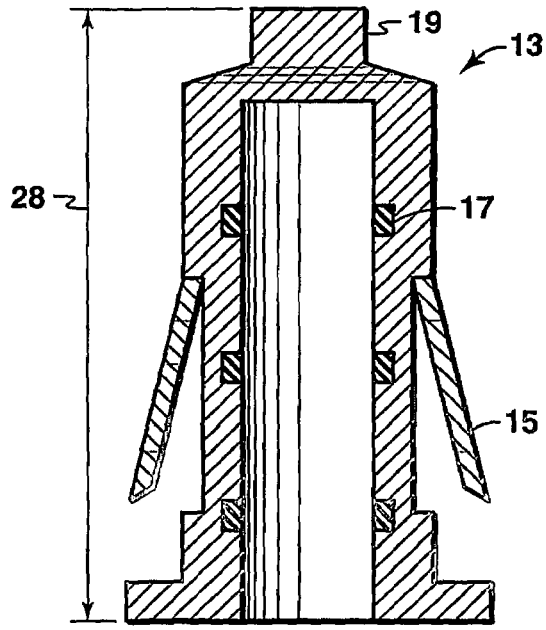
FIG. 2 is an illustration of an overshot section milling assembly.

FIG. 2 shows an overshot section milling assembly 13. This tool assembly is designed to fit over and latch to the drillpipe stinger stub (not shown). After landing on the drillpipe stinger, the overshot section milling assembly may be appropriately released from the drillpipe stringer assembly to allow axial and rotational movement to facilitate casing cutting and formation underreaming operations. The retractable cutting arms 15 on the tool assembly are activated by pump pressure and drillstring rotation and will be capable of removing existing casing as well as enlarging the borehole. Appropriate wiper seals 17 are included in the overshot bore to achieve a low-pressure seal barrier to exclude drill solids and milling debris. Typically, the top of the overshot section milling assembly provides a drillpipe tool joint 19 (box connection) to removedly connect (or attach with the ability to disconnect) the overshot section milling assembly to a drillpipe. In FIG. 2, the entire height 28 of the overshot section milling assembly 13 is approximately 5 to 10 meters.

While this patent specifically discusses the use of a mechanical cutting tool (such as an overshot section milling assembly) persons skilled in the art would recognize other methods that could be utilized to create a large downhole cavity. These methods include but are not limited to chemical cutting, water-jet cutting, laser cutting, explosive cutting, and shaped-charge cutting.

Figure 3B:
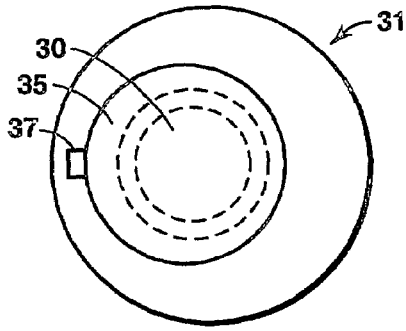
FIG. 3(*a*) is a side view illustration of an external overshot whipstock assembly.
Figure 3A:
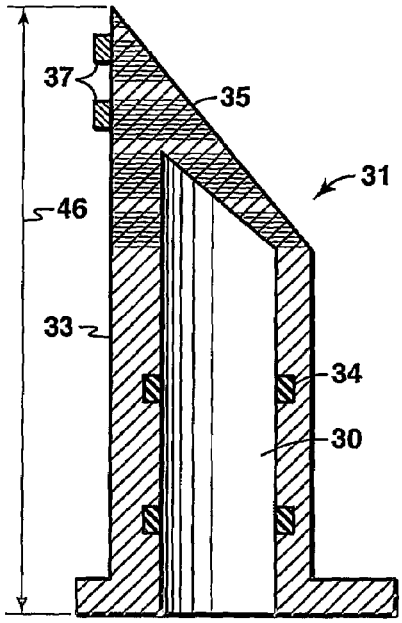

FIG. 3(*a*) shows an illustration of an overshot whipstock assembly 31. As illustrated in FIG. 3(*a*), this tool assembly is designed to fit over and latch to the drillpipe stinger stub (not shown) in a manner similar to the overshot section-milling assembly. The internal bore 30 of this tool assembly will mate with the tapered surface of the drillpipe stinger assembly (not shown) and be offset to one side of the wellbore casing. The offset nature of the whipstock allows the back 33 of the whipface assembly to be supported against the existing borehole casing and provides adequate clearance for the drilling assembly to deflect off the whipstock face 35 into the excavated section-milled cavity. Whipface supports 37 may be added to the back 33 of the overshot whipstock assembly 31 to provide additional support against the borehole casing. Low-pressure wiper seals 34 can be aligned with the fluid ports of the drillpipe stinger (not shown) to prevent mixing of fluid below the whipstock packer with fluid above the whipstock packer. In the FIG. 3(*a*) illustration, the entire height 46 of the overshot whipstock assembly 31 is approximately 5 to 10 meters.

FIG. 3(*b*) is a top view of the overshot whipstock assembly 31 in which the like elements to FIG. 3(*a*) have like numerals. FIG. 3(*b*) shows the tapered surface of the overshot whipstock assembly whipface 35 to deflect the drilling assembly into the excavated cavity.

Figure 4B:
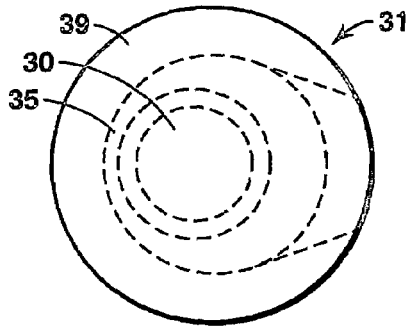
FIG. 4(*a*) is a side view illustration of an internal overshot whipstock assembly.
Figure 4A:
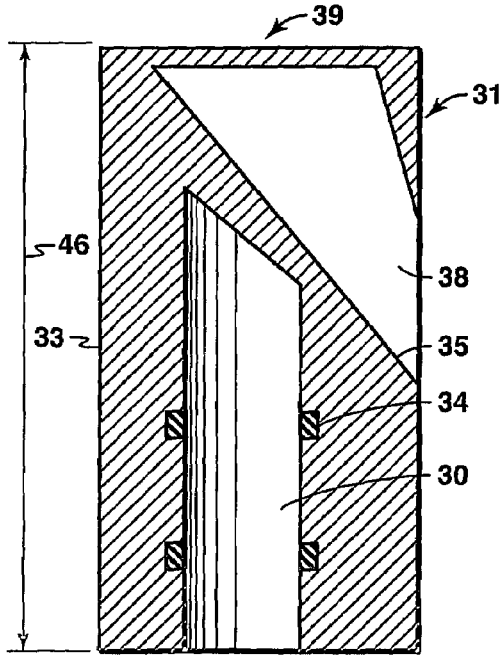

Both internal and external overshot whipstock assemblies could be utilized. FIGS. 3(*a*) and 3(*b*) shows an external whipstock assembly. FIGS. 4(*a*) and 4(*b*) shows an internal whipstock assembly 31 in which the like elements to FIG. 3(*a*) have like numerals. The internal overshot whipstock assembly whipface 35 is covered by a top 39 comprising a lateral bore 38 through which the drilling assembly can be inserted through the top 39 of the overshot whipstock assembly 31. When inserted, the drilling assembly would deflect off the whipface 35 through the lateral bore 38 into the side of the wellbore to create a kick-off through the excavated cavity. Persons skilled in the art can optimize the size and shape of the overshot whipstock assembly based upon the actual lengths of the drillpipe stinger assembly and the section-milled cavity. In the FIG. 4(*a*) illustration, the entire height 46 of the overshot section milling assembly 31 is approximately 5 to 10 meters.

The preferred use of this invention is specifically to excavate a large downhole cavity for the creation of multi-lateral wells. However, persons skilled in the art will recognize other uses of an excavated cavity including downhole equipment storage areas and construction zones for downhole structures or pieces of equipment.

EXAMPLE

Figure 5:
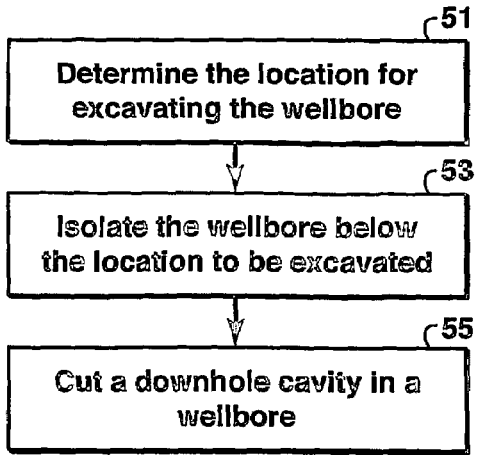
FIG. 5 is a flowchart illustration of a method to excavate a wellbore.

FIG. 5 is a flow chart of an embodiment for the method to create an excavated cavity in a wellbore. As illustrated in FIG. 5, the first step is to determine the location for excavating a wellbore 51. The second step is to isolate the wellbore below the location to be excavated 53. The third step is to create a downhole cavity in a wellbore 55.

Figure 6:
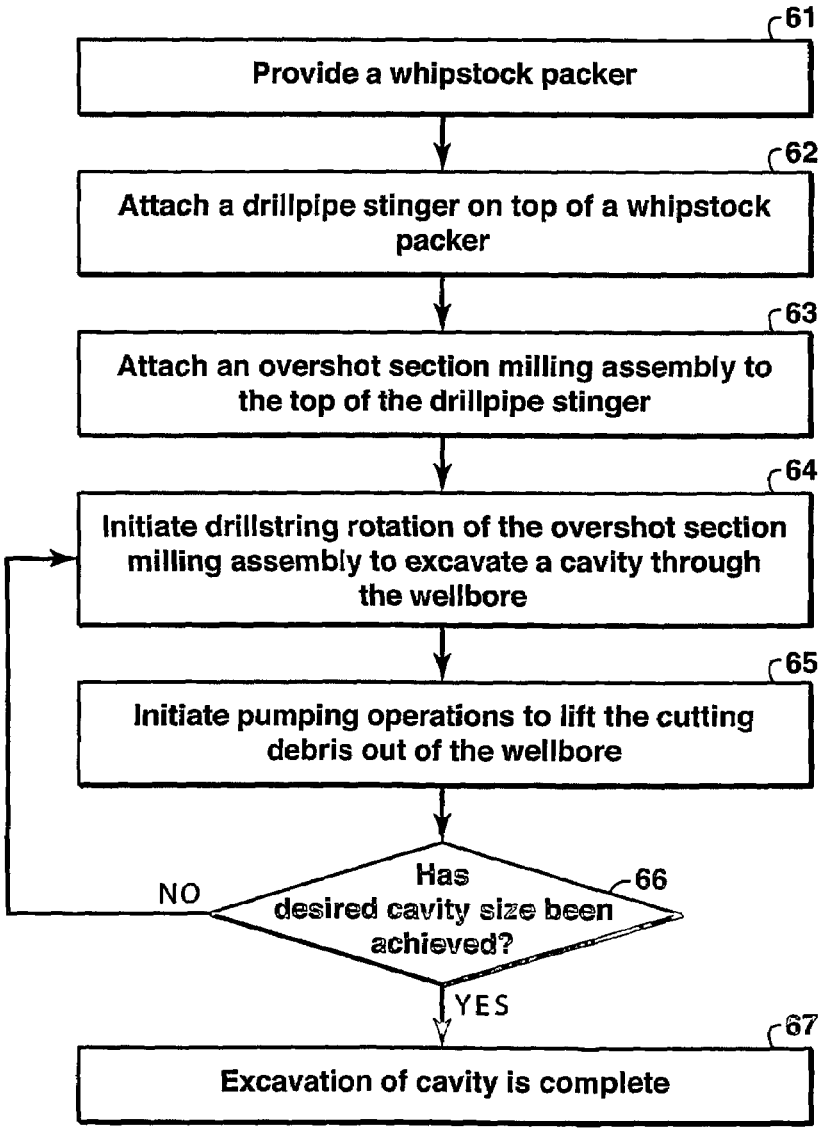
FIG. 6 is a flowchart illustration of a second embodiment of the method to excavate a wellbore.

FIG. 6 is a flow chart of a second more detailed method embodiment for excavating a cavity in a wellbore. It is envisioned that the steps listed in FIG. 6 would be the preferred utilized steps during the downhole excavation process, and the steps are illustrated in FIGS. 8 to 13. Persons skilled in the art would recognize that the order in which these procedures are performed could be changed to accomplish various drilling and completion objectives. Also, these procedures are applicable to wells at any inclination ranging from vertical to horizontal wells and include the provision for creating multiple casing exits at approximately the same measured depth of the well.

Figure 8:
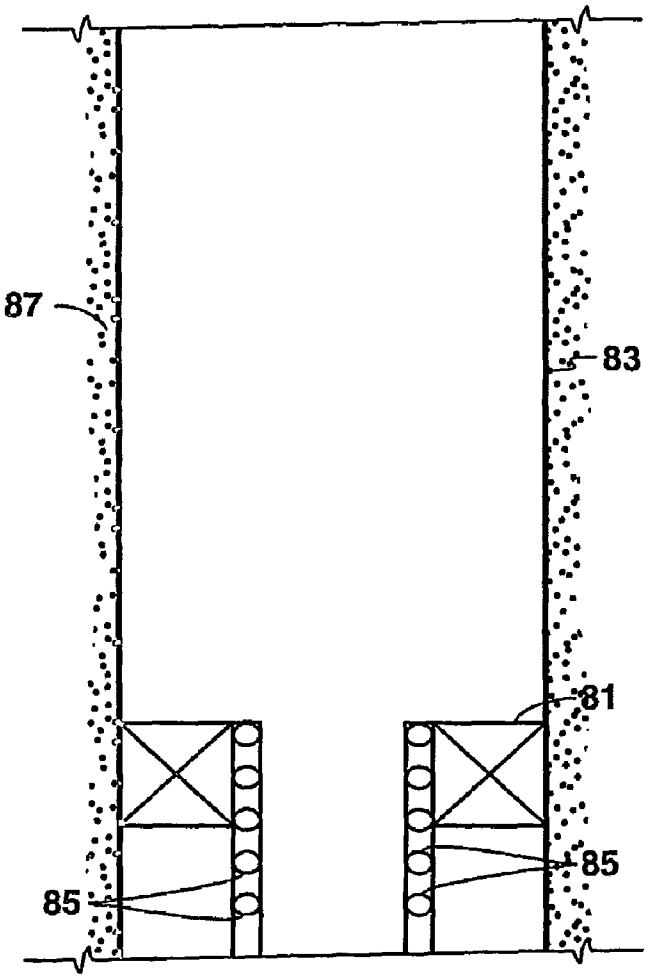
FIG. 8 is an illustration of a whipstock packer in a wellbore for isolating the section of the wellbore below the whipstock packer.

Referring to FIG. 6, a conventional whipstock orienting packer is first run in the well and can be set hydraulically or using wireline to isolate the wellbore at a location in the wellbore 61. As illustrated in FIG. 8, the whipstock packer 81 is then is oriented along the casing wall 83 of the wellbore 87 to facilitate subsequent operations. Also illustrated are seal stack receptacles 85 designed to seal the whipstock packer against the drillpipe stinger (not shown).

Figure 9:
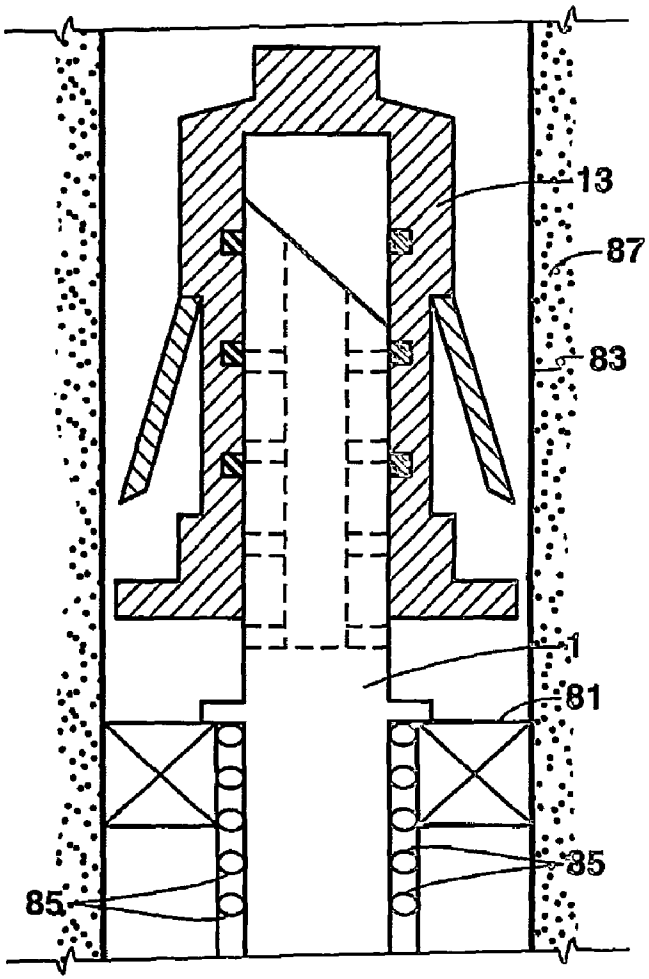
FIG. 9 is an illustration of a wellbore with a drillpipe stinger inserted into the whipstock packer and a section milling assemble mated above the drillpipe stinger.

Referring to FIG. 6, a drillpipe stinger is next attached or mated on top of a whipstock packer 62 and then an overshot section milling assembly is attached to the top of the drillpipe stinger 63. FIG. 9 shows a drillpipe stinger 1 latched onto a whipstock packer 81 with an overshot section milling assembly 13 mated above the drillpipe stinger 1 inside the casing 83 of the wellbore 87.

Figure 10:
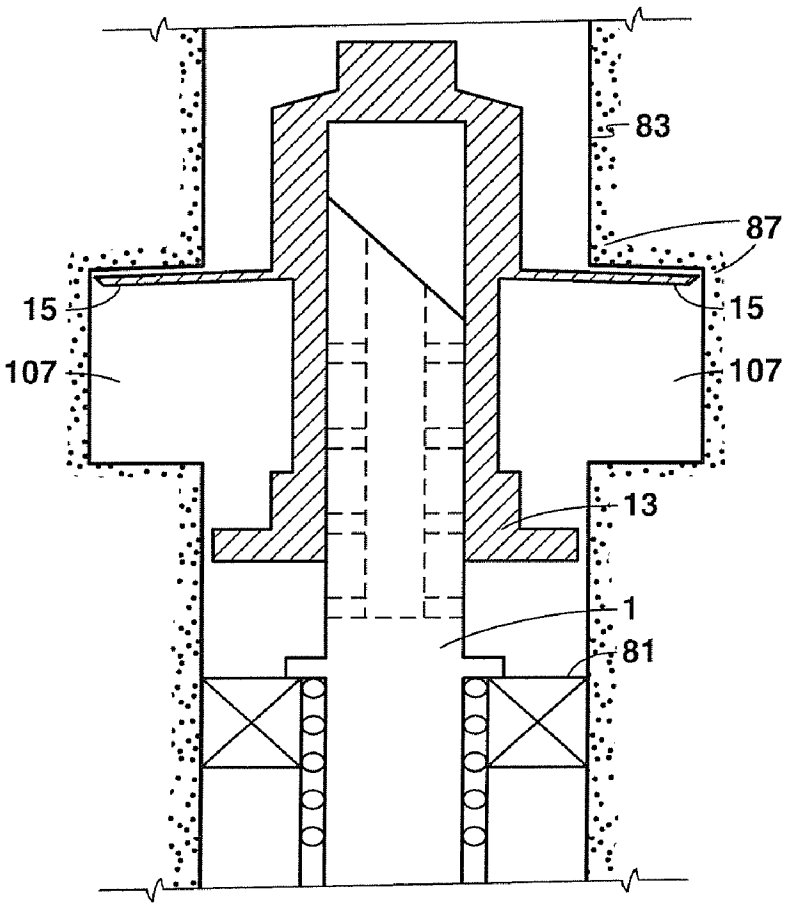
FIG. 10 is an illustration of the activation of the section milling assembly of FIG. 9 to excavate a section-milled cavity.

Referring to FIG. 6, the next step is to initiate drillstring rotation of the overshot section milling assembly to excavate a cavity 64 with initiation of pumping operations to lift the cutting debris out of the wellbore 65. FIG. 10 shows an illustration of the apparatus of FIG. 9 after initiation of pumping operations and drillstring rotation wherein like elements of FIG. 9 use the same number designations. The drillstring rotation extends the section-mill retractable arms 15, to remove the casing wall 83 of the wellbore 87, cut the excavation cavity 107 and the pumping operations lift the cutting debris out of the wellbore 87.

Referring to FIG. 6, a determination is made if the desired cavity size has been achieved 66. If the desired cavity size has been achieved, the excavation is complete 67. If the desired cavity size has not been achieved repeat the previous two operations (64 and 65), as necessary, by initiating drillstring rotation to cut the cavity 107.

Figure 11:
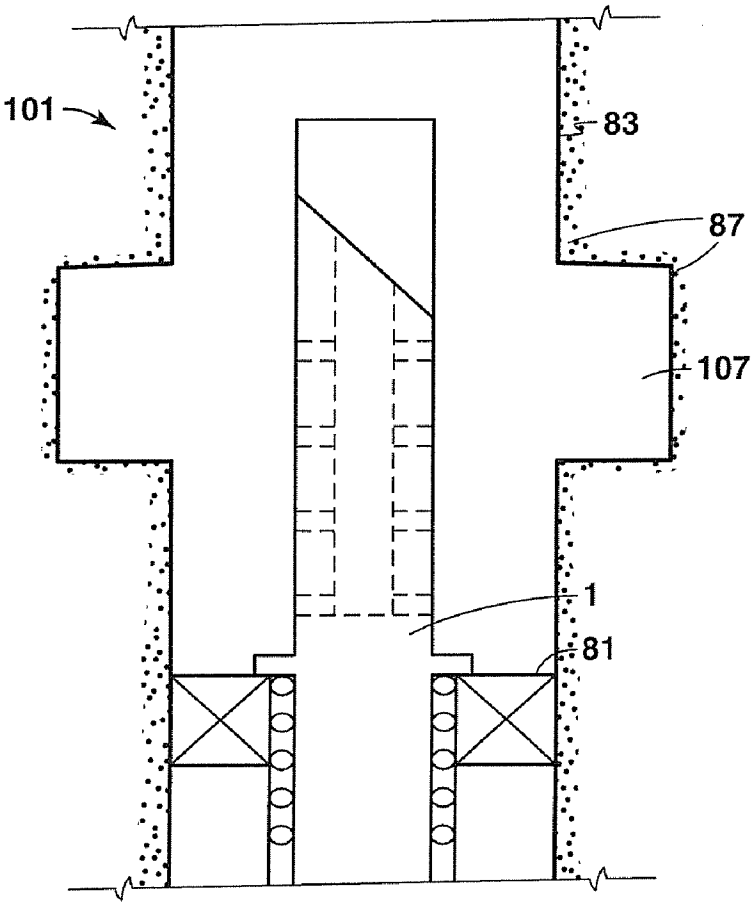
FIG. 11 is an illustration of wellbore after the removal of the section milling assembly after the excavation of the section-milled cavity.

Upon completion of cavity, the overshot section-milling assembly is removed from the wellbore. FIG. 11 shows the whipstock packer 81 inside the casing 83 of the wellbore 87 after the overshot section milling assembly has been removed leaving the whipstock packer 81, the drillpipe stinger 1 and the excavated cavity 107.

Figure 7:
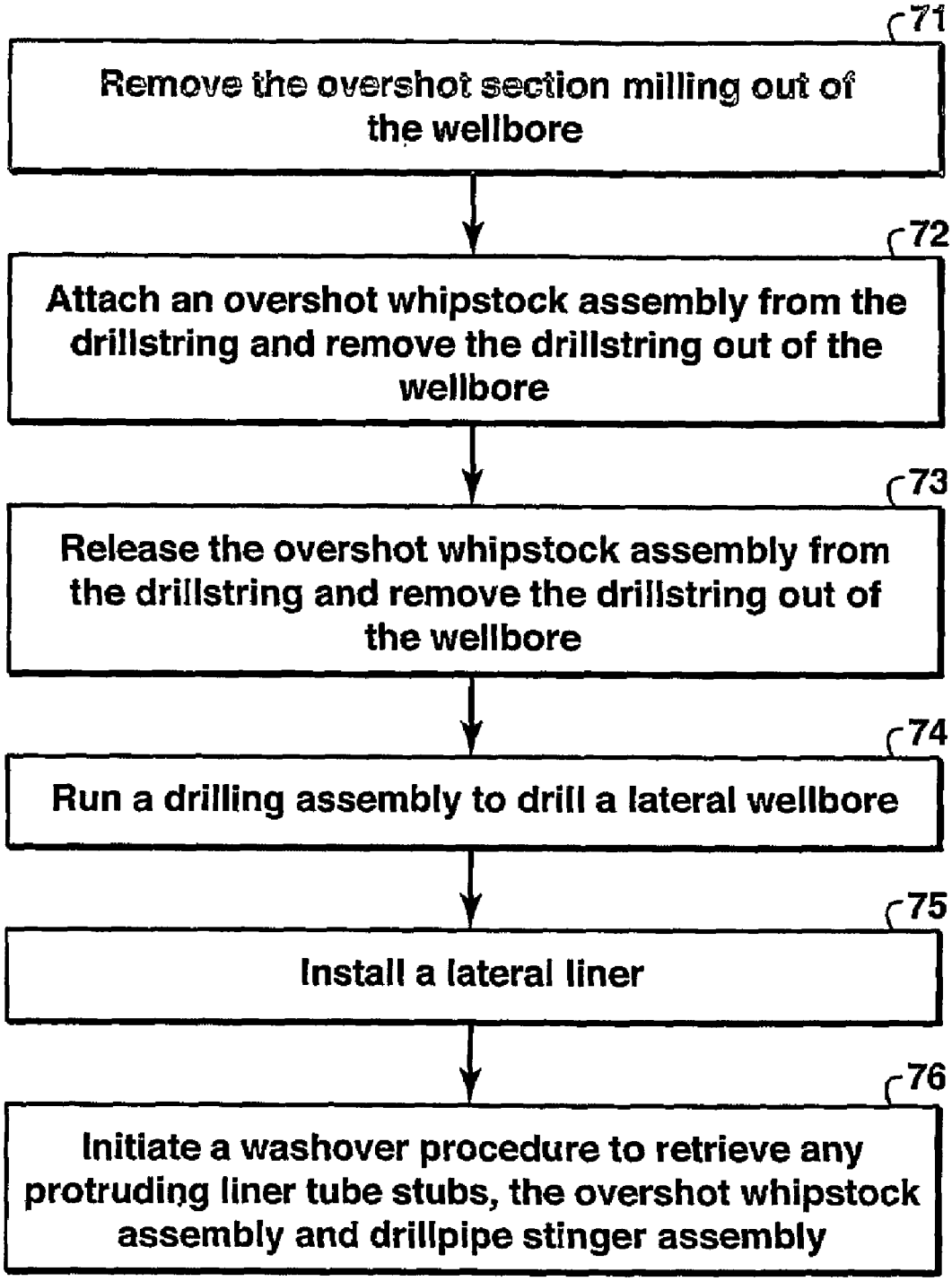
FIG. 7 is a flowchart illustration of a third embodiment of the method to perform lateral drilling through a excavated cavity.

At this point, one of several operations could be performed to prepare the cavity for multi-lateral well juncture creation or lateral drilling. FIG. 7 is a flow chart of an operation to perform lateral drilling through the excavated cavity in the wellbore. FIG. 7 begins where FIG. 6 ended and requires that the overshot section milling assembly be removed out of the wellbore 87. Next, the overshot whipstock assembly is installed. One method to accomplish installation of the overshot whipstock assembly is to run the overshot whipstock assembly on a drillstring and stab it over the drillpipe stinger 1. Next, the drillstring is released from the overshot whipstock assembly and pulled out of the wellbore 73.

Figure 12:
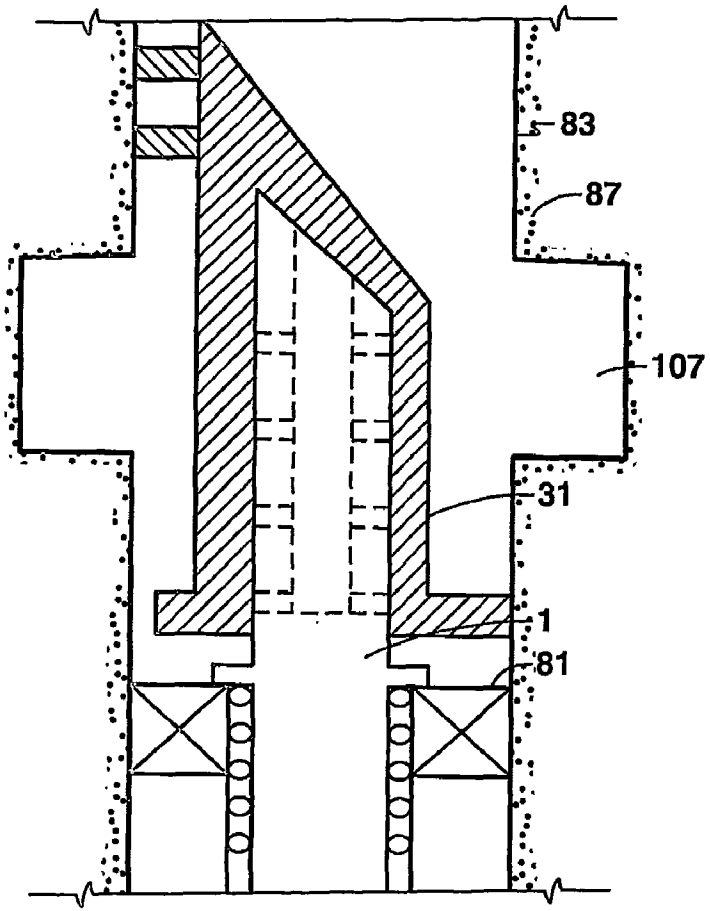
FIG. 12 is an illustration of an external whipstock mated on top of the drillpipe stinger after the removal of the section milling assembly.

FIG. 12 shows an external overshot whipstock 31 mated on top of the drillpipe stinger 1 in a wellbore 87 wherein like elements from FIG. 3(*a*) are given like numerals. Referring to FIG. 7, the drilling assembly is run and a lateral bore is drilled 74. In this example, an external overshot whipstock was utilized. However, an internal overshot whipstock could be utilized in the same manner as the external overshot whipstock. The overshot whipstock could be oriented at any angle within the excavated cavity, making it possible to drill a lateral bore at any azimuth.

Figure 13:
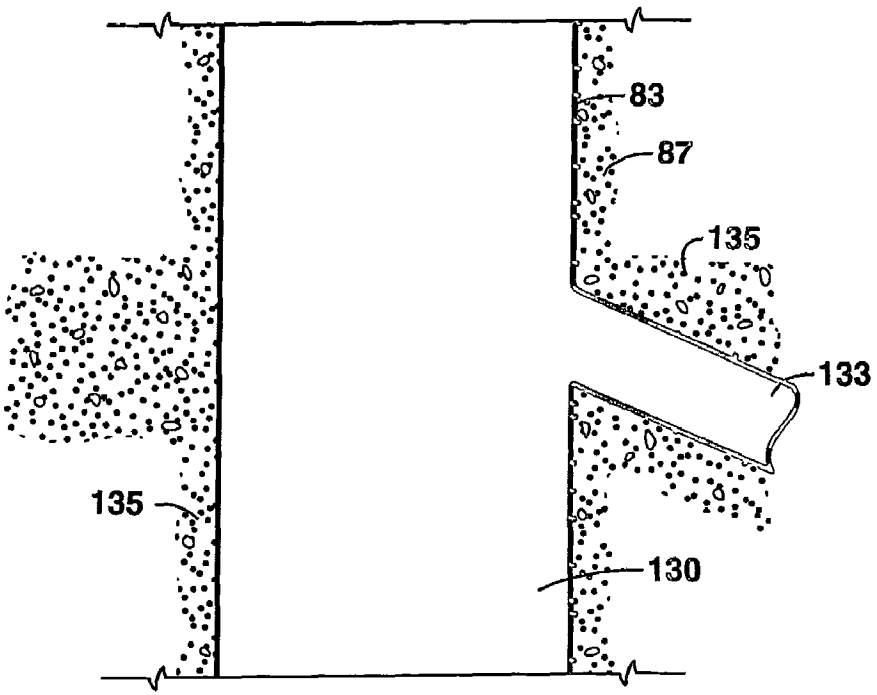
FIG. 13 is an illustration of a cased wellbore after a lateral bore has been drilled through the excavated cavity and the whipstock packer, drillpipe stinger and whipstock assembly has been removed.

At the conclusion of lateral drilling procedures, a lateral liner may be installed in the wellbore using conventional methods 75, including cementing the liner. After running the liner, the liner stub protruding from the lateral, the overshot whipstock assembly, and the drillpipe stinger assembly can all be retrieved using conventional washover procedures 76. FIG. 13 shows the wellbore 87 with the equipment removed leaving the central wellbore 130 with a lateral bore 133 and cement 135 around the exterior of the casing 83 and the lateral bore 133. In the example given above only one lateral bore was drilled. However, multiple lateral wells could be drilled through the same excavation cavity or through multiple excavation cavities.

What is claimed is:

1. An apparatus for excavating in a wellbore comprising, (a) a whipstock packer capable of isolating the wellbore below the whipstock packer; and (b) a drillpipe stinger inserted into the whipstock packer, the drillpipe stinger comprising, a hollow ported-stub, means for the ports on the drillpipe stinger to direct drilling fluid flow to the annulus between a drillstring and casing, and a tapered top on the drillpipe stinger adapted to receive an overshot section milling assembly.

2. The apparatus of claim 1 further comprising an overshot section milling assembly latched to the tapered top of the drillpipe stinger, the overshot section milling assembly comprising at least one retractable cutting arm, means for activating the retractable cutting arm by rotational movement to perform casing cutting and formation undereaming operations.

3. The apparatus of claim 2 further comprising at least one wiper seal on the inside of the overshot section milling assembly wherein the wiper seal achieves a low-pressure seal barrier with the drillpipe stinger to exclude drill solids and milling debris.

4. The apparatus of claim 1 wherein the tapered top of the drillpipe stinger is adapted to attach an overshot whipstock assembly and further comprising an overshot whipstock assembly attached to the drillpipe stinger, the overshot whipstock assembly comprising a whipface with an offset to a side of the wellbore casing.

5. The apparatus of claim 4 wherein the overshot whipstock assembly is an internal whipstock assembly.

6. The apparatus of claim 4 wherein the overshot whipstock assembly is an external whipstock assembly.

7. A method for excavating a wellbore comprising, (a) installing a packer in a wellbore at a desired orientation;

(b) attaching a drillpipe stinger on top of the packer, the drillpipe stinger comprising a tapered top adapted to attach an overshot section milling assembly on top of the drillpipe stinger and a hollow ported-stub, means for the drillpipe stinger ports to direct flow of drilling fluids to the annulus between the drillstring and casing wherein the circulation of drilling fluids removes drill cuttings;

(c) attaching an overshot section milling assembly to the tapered top on the drillpipe stinger;

(d) initiating the drillstring rotation to extend a section-mill retractable arm to cut a cavity in the casing;

(e) initiating pumping operations to lift the cutting debris out of the well; and (f) repeating steps (d) and (e) until the cavity has the desired size.

8. The method of claim 7 further comprising removing the overshot section milling assembly from the wellbore.

9. The method of claim 8 further comprising removing the drillpipe stinger and packer thereby providing full access to the wellbore and the excavated cavity.

10. The method of claim 7 wherein the tapered drillpipe stinger top is adapted to attach an overshot whipstock assembly and further comprising;

(a) providing an overshot whipstock assembly on a drillstring and attaching the overshot whipstock assembly on the tapered top of the drillpipe stinger;

(b) releasing the drillpipe stinger from the overshot whipstock assembly and pulling the drillstring out of the wellbore; and (c) running a drilling assembly to drill a lateral bore.

11. The method of claim 10 further comprising removing the overshot whipstock assembly, drillpipe stinger and packer, thereby providing full access to the wellbore and the cavity.

12. The method of claim 10 further comprising cementing a lateral liner in the lateral bore.

13. The method of claim 12 further comprising a washover procedure wherein the washover procedure retrieves the liner stub protruding from the lateral bore, the overshot whipstock assembly and the drillpipe stinger assembly.

* * * * *